US009964260B2

(12) United States Patent
Haenen et al.

(10) Patent No.: US 9,964,260 B2
(45) Date of Patent: May 8, 2018

(54) LED LIGHTING DEVICE WITH IMPROVED LIGHT DISTRIBUTION

(71) Applicant: KONINKLIJKE PHILIPS N.V., Eindhoven (NL)

(72) Inventors: Ludovicus Johannes Lambertus Haenen, Eindhoven (NL); Nils Benter, Eindhoven (NL); Jelle Peter Pelsma, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days. days.

(21) Appl. No.: 14/941,449

(22) Filed: Nov. 13, 2015

(65) Prior Publication Data

US 2016/0138765 A1 May 19, 2016

Related U.S. Application Data

(62) Division of application No. 14/114,244, filed as application No. PCT/IB2012/052054 on Apr. 24, 2012, now abandoned.

(30) Foreign Application Priority Data

Apr. 29, 2011 (EP) ..... 11305509

(51) Int. Cl.
*F21S 4/00* (2016.01)
*F21V 21/00* (2006.01)
(Continued)

(52) U.S. Cl.
CPC ..... *F21K 9/30* (2013.01); *F21K 9/232* (2016.08); *F21K 99/00* (2013.01); *F21S 41/141* (2018.01);
(Continued)

(58) Field of Classification Search
CPC ..... F21K 9/00; F21K 9/30; F21K 9/50; F21K 99/00; F21V 19/001; F21V 19/003; F21Y 2111/005
(Continued)

(56) References Cited

U.S. PATENT DOCUMENTS 7,079,041 B2 7/2006 Fredericks et al.
7,118,261 B2 * 10/2006 Fredericks ..... B64D 47/06 362/249.14
(Continued)

FOREIGN PATENT DOCUMENTS

CN 2791467 Y 6/2006
CN 101315177 A 12/2008
(Continued)

OTHER PUBLICATIONS

EPO as ISA, PCT/IB2012/052054, "International Search Report and Written Opinion", dated Aug. 10, 2012, 9 pages.
(Continued)

*Primary Examiner* — Jason Moon Han

(57) ABSTRACT

A lighting device and a lighting unit comprising a reflector and a lighting device, or LED lamp are described. The LED lamp have a first and a second LED assembly. Each LED assembly comprises at least one LED element with an LED chip and a carrier with a flat surface for carrying the LED chip. The LED chip emits light with a main optical direction. The first and second LED assembly are mounted relative to each other so that at least a first LED element from the first LED assembly and a second LED element from the second LED assembly enclose a rotating angle (γ) between their respective flat surfaces with respect to an axis of rotation (A) so as to involve light angle between the first and second main optical directions. The axis of rotation (A) is parallel to a plane of a flat carrier surface of at least one LED element. The first and second LED assemblies are arranged
(Continued)

offset from each other parallel to the axis of rotation (A). Thus, a lighting device with small dimensions and advantageous light distribution is obtained.

3 Claims, 7 Drawing Sheets

(51) Int. Cl.

| | |
|---|---|
| ***F21K 99/00*** | (2016.01) |
| ***F21K 9/232*** | (2016.01) |
| *F21V 19/00* | (2006.01) |
| *F21Y 105/10* | (2016.01) |
| *F21Y 115/10* | (2016.01) |
| *F21Y 107/30* | (2016.01) |

(52) U.S. Cl.
CPC ..... *F21S 41/192* (2018.01); *F21S 43/14* (2018.01); *F21S 43/195* (2018.01); *F21S 45/47* (2018.01); *F21V 19/001* (2013.01); *F21Y 2105/10* (2016.08); *F21Y 2107/30* (2016.08); *F21Y 2115/10* (2016.08)

(58) Field of Classification Search
USPC ..... 362/249.02–249.03, 545, 800
See application file for complete search history.

(56) References Cited

U.S. PATENT DOCUMENTS

| | | | | |
|---|---|---|---|---|
| 7,252,405 | B2 | 8/2007 | Trenchard et al. | |
| 8,072,123 | B1 * | 12/2011 | Han | F21K 9/65 313/45 |
| 2004/0095777 | A1 | 5/2004 | Trenchard et al. | |
| 2007/0080645 | A1 | 4/2007 | Smith | |
| 2008/0055898 | A1 | 3/2008 | Deng | |
| 2010/0008085 | A1 | 1/2010 | Ivey et al. | |
| 2010/0213809 | A1 | 8/2010 | Roehl et al. | |

FOREIGN PATENT DOCUMENTS

| | | | |
|---|---|---|---|
| CN | 101598266 | A | 12/2009 |
| CN | 201757304 | U | 3/2011 |
| DE | 19624087 | A1 | 12/1997 |
| DE | 202010006197 | U1 | 7/2010 |
| EP | 2202458 | A2 | 6/2010 |
| JP | 2002334604 | A | 11/2002 |
| JP | 2007173034 | A | 7/2007 |
| JP | 2011023375 | A | 2/2011 |

OTHER PUBLICATIONS

First Office Action dated Dec. 31, 2015 from Chinese Patent Application No. 201280020249.8.
Office Action dated Feb. 2, 2016 from Japanese Patent Application No. 2014-506972.
Office Action, European Application No. 12720653.0-1757 dated Apr. 7, 2016, 5 pages.
Official Action dated Apr. 14, 2016, Russia Patent Application No. 2013152968/07, 4 pages.
Second Office Action dated Jul. 6, 2016, China Patent Application No. 201280020249.8, 15 pages.
Fourth Office Action dated Mar. 17, 2017, Chinese Patent Application No. 201280020249.8, 16 pages.
EP Office Action dated Mar. 22, 2017, European Application No. 12720653.0, 8 pages.

* cited by examiner

FIG. 1
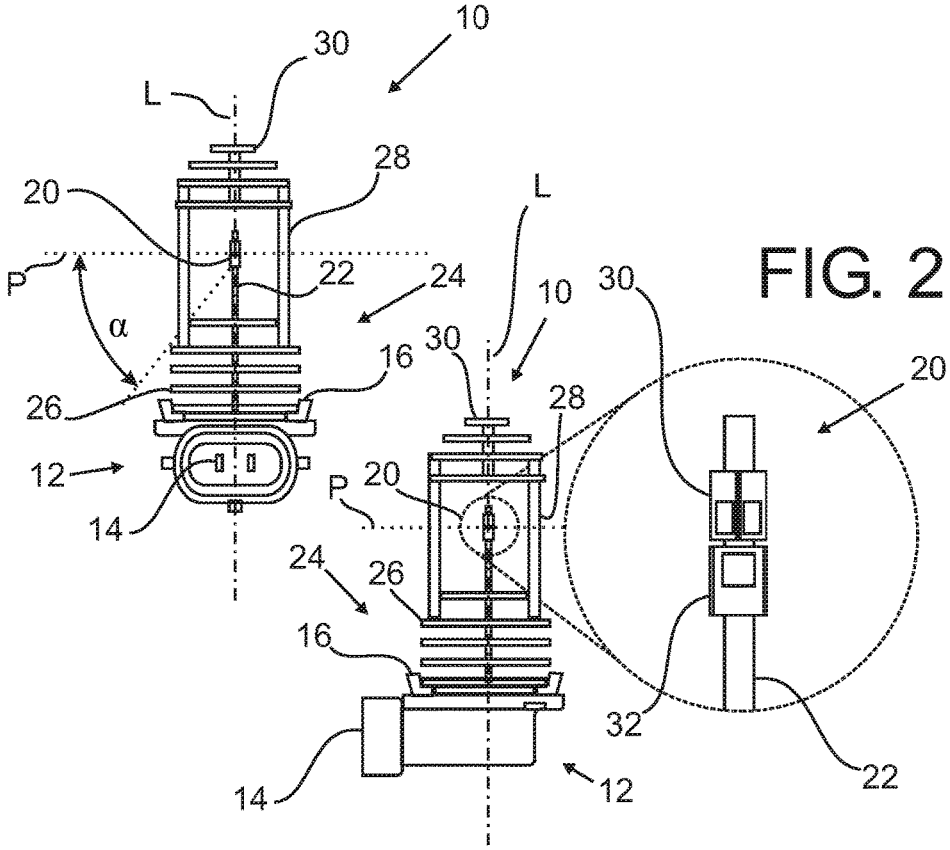
FIG. 2
FIG. 3
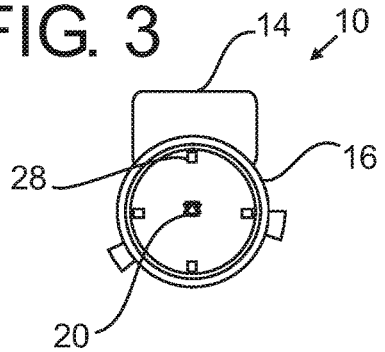
FIG. 4
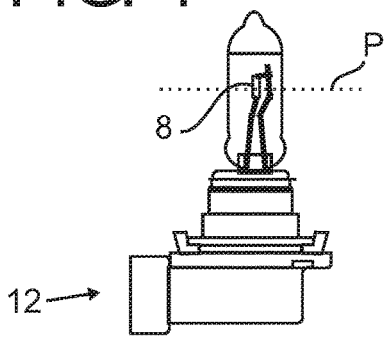
(prior art)

FIG. 5a
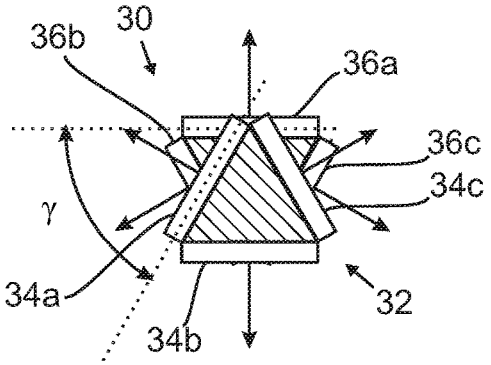
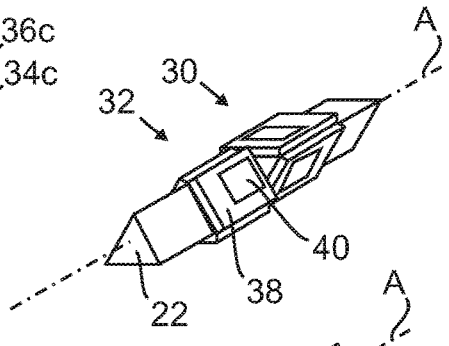
FIG. 5b
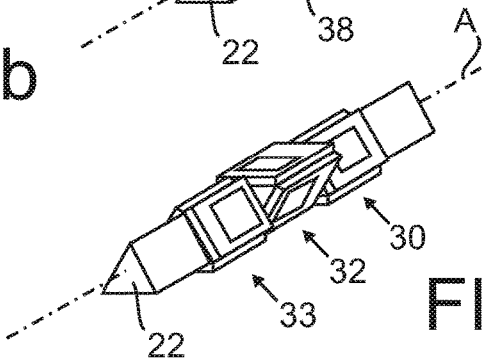
FIG. 6
FIG. 7a
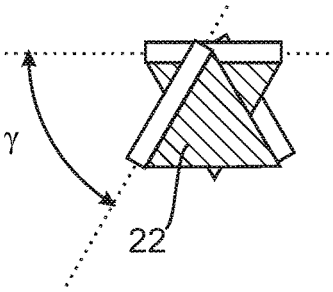
FIG. 7b
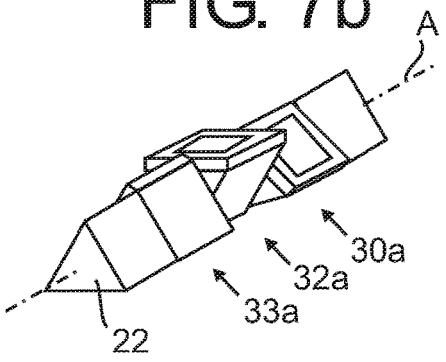

FIG. 8a
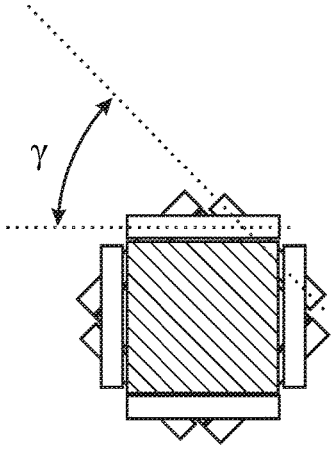
FIG. 8b
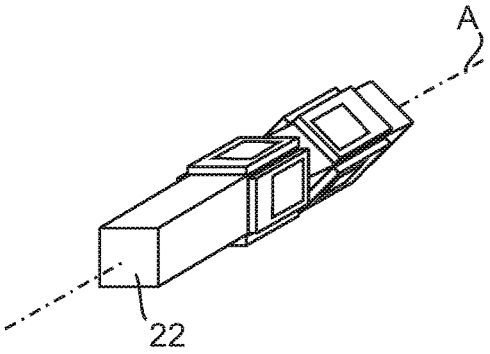
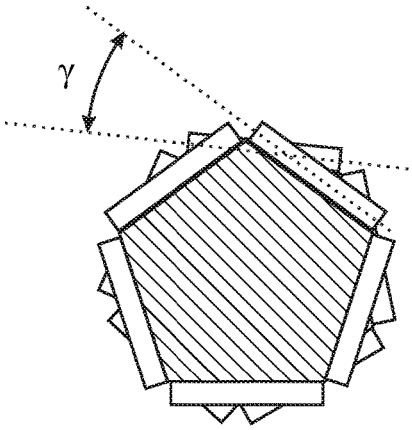
FIG. 9a
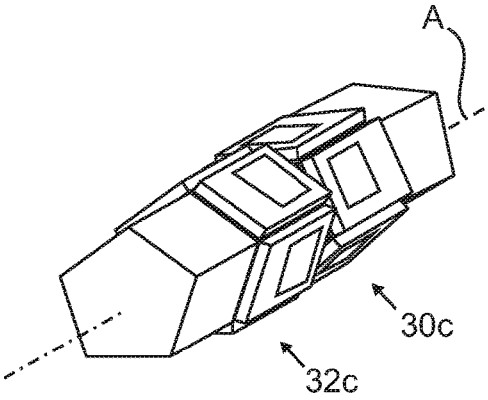
FIG. 9b

FIG. 10
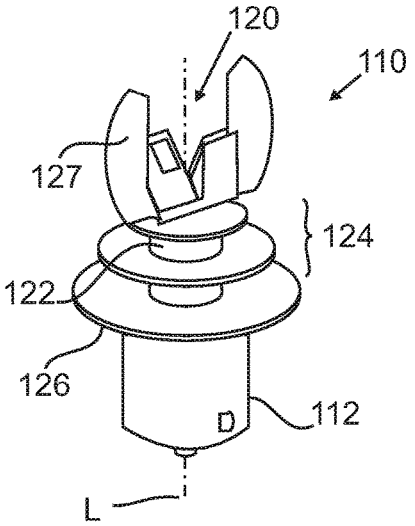
FIG. 11
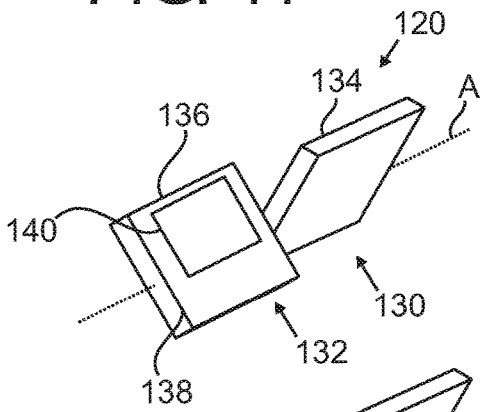
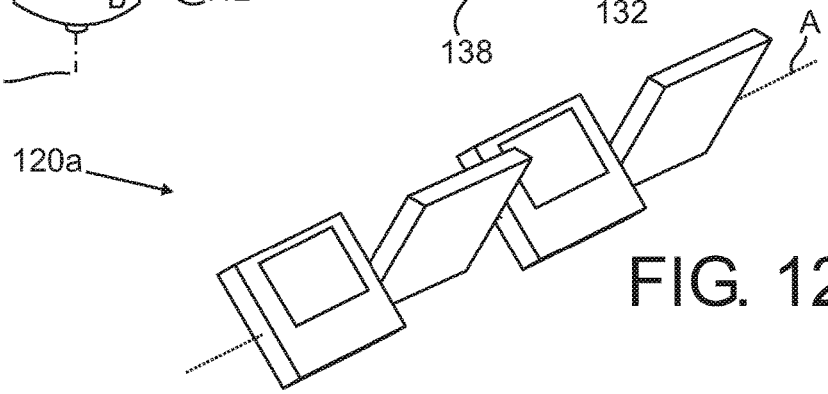
FIG. 12
FIG. 13
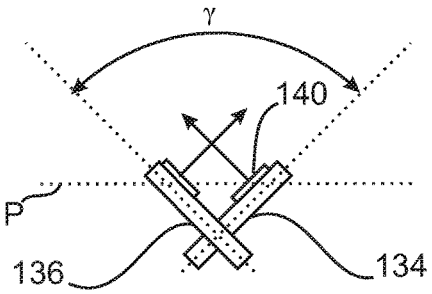
FIG. 14
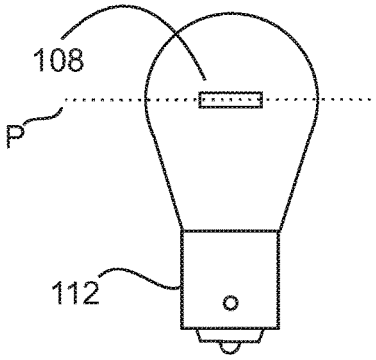
(prior art)

LED LIGHTING DEVICE WITH IMPROVED LIGHT DISTRIBUTION

CROSS-REFERENCE TO RELATED APPLICATIONS

This application is a divisional of U.S. patent application Ser. No. 14/114,244, filed Oct. 28, 2013, titled "LED lighting device with improved light distribution" which is a 371(c) national stage entry of PCT/IB12/52054 filed on Apr. 24, 2012, which are incorporated herein by reference.

FIELD OF THE INVENTION

The invention relates to the field of lighting, and more specifically to an LED lighting device. In particular, the invention relates to a lighting device with multiple LED elements, mounted relative to each other to achieve an advantageous light distribution, in particular for automotive lighting.

BACKGROUND OF THE INVENTION

In the field of electrical lighting, LED (light emitting diode) elements are increasingly used due to their advantageous properties of high efficiency and long lifetime. Also, LEDs are already used for automotive lighting, including both automotive signaling lamps and automotive front lighting.

Mostly available today are flat LED packages, in the following referred to as "LED elements", i. e. LED chips mounted on a flat carrier plate of e. g. rectangular shape. Several attempts have been made to employ such flat LED elements in LED lamps, in particular to replace existing automotive lamps such as (halogen) incandescent lamps.

In DE-A1-19624087 a lighting device is described comprising a plurality of LEDs, each emitting light into a preferred direction. A holding arrangement holds the LEDs in a predetermined arrangement relative to each other such that at least two of the LED point light sources emit light into different directions. In different embodiments, LEDs are mounted on plates, which may be arranged under different angles, or on an LED beam tube carrying multiple LEDs in three dimensional arrangement. The cross-sectional shape of the beam tube may be e. g. triangular, rectangular or other.

SUMMARY OF THE INVENTION

It is an object of the present invention to provide an LED lighting device with improved light distribution and small dimensions.

According to the invention, this object is solved by a lamp according to claim 1 and by a lighting unit according to claim 14. Dependent claims refer to preferred embodiments of the invention.

It is a basic idea of the present invention to provide a lighting device with LED elements arranged to form a light emitting structure of small dimensions, which at the same time provides an illumination which is well distributed into different directions. In particular for LED lighting devices replacing (halogen) incandescent lamps, the present inventors have found that many prior art solutions provide extremely large mounting structures for LEDs, the dimensions of which are far beyond the size of the filaments of existing incandescent lamps. The present invention makes it possible, to provide a very compact arrangement of LED elements with well distributed light emission. For the replacement of halogen lamps, the invention makes it possible to achieve intensity distributions that satisfy, contrary to prior art solutions, the requirements especially in automotive lamps, and in particular also for automotive front lighting lamps.

According to the invention, the lighting device, or LED lamp, comprises at least two LED assemblies. Each LED assembly is comprised of at least one LED element, but may comprise several LED elements in a specified relative arrangement. In the present context, the term "LED element" is to be understood as a carrier with a flat surface, carrying the actual light emitting LED chip on a planar carrier surface. Such LED elements, or LED packages, are commercially available. The LED element will emit light from the LED chip. A main optical direction of the light emission may be defined either as a spatial angle under which a maximum intensity is emitted, or, in case of uniform emission, as the center of the emission directions. In most cases, in particular where no primary optics such as lenses etc. are provided at the LED element to modify light emission, the main optical direction will be perpendicular to the plane of the flat carrier on which the LED chip is mounted.

It is a central idea of the invention to arrange the LED assemblies along an axis, here termed a rotation axis. The LED elements are arranged relative to this rotation axis such that the plane of at least one, preferably of two or more LED elements, most preferred LED elements from both the first and second LED assembly, are parallel to the rotation axis. Further, the two LED assemblies are arranged both under a rotation angle around the thus defined rotation axis, and under an offset, i. e. a displacement along or parallel to this rotation axis.

The rotation angle leads to a light angle between the main optical directions of light emissions of a first LED element from the first LED assembly and a second LED element from the second LED assembly. The offset allows to place the LED elements in close proximity to obtain a compact arrangement. Generally, it is preferred for all LED elements in the LED lighting device to be of identical type, e. g. identical dimensions.

As will be shown for preferred embodiments, this combination of

- offset along a longitudinal axis, and
- a rotation angle between the flat surfaces, and thus a light angle allows to achieve LED lighting devices with small dimensions and an even light distribution of the resulting light emission.

As the skilled person will appreciate, and as will be shown for preferred embodiments, the rotation angle may be observed in a view along the rotation axis. The angle may be defined between planes of the flat carrier surfaces of the first and second LED element. It should, however, be noted that the above definition of a rotation angle does not exclude that the first and second LED element may be arranged e. g. in mirrored or additionally otherwise rotated configuration.

In the case of each LED assembly comprising only one LED element, the rotation angle and offset along the rotation axis may be defined between those two LED elements. In the case of more LED elements, it is preferred that the first and second LED assembly comprise the same number of LED elements in the same relative arrangement for both LED assemblies. While it is generally possible to define the described rotation and offset between only a first LED element from the first LED assembly and a second LED element from the second LED assembly, arrangements are preferred where this rotation and offset may be found pairwise between LED elements from the first and from the second LED assembly (where again mirrored arrangements or further rotations may be possible).

The offset between the LED elements is preferably small to achieve a lighting device of small encumbrance. Preferable the offset is less than twice the length dimension of the LED element in the direction of the rotation axis, further preferred less than 1.5 times this dimension, and most preferred approximately 1.0-1.1 times the dimension, so that, in the direction of the rotation axis, the assemblies may be arranged close to each other, preferably right next to each other.

The lighting device according to the invention achieves a spatial distribution of the emitted light that is relatively uniform. At the same time, the extension of the structure emitting light is very small due to the compact arrangement of LED elements. While the absolute size of the light emitting structure will depend on the size of available LED elements, the relative size has proven to be exceptionally small for the achieved uniform lighting distribution.

Different values may be chosen for the rotating angle. Preferably, in many applications, the rotating angle may be more than 0° and less than 90°. In the preferred case of identical configurations of multiple LED elements in both the first and second LED assembly, the rotating angle will be chosen to be less than 360° divided by the number of LED elements in each LED assembly, preferably at about (+/−10%) 180°/N, where N is the number of LED elements per LED assembly. So, for LED assemblies of two LED elements each, the rotating angle will preferably be at about 90°, whereas for LED assemblies of 3 LED elements each the rotating angle will preferably be at around 60°.

It should be noted that the above values for rotating angles generally refer to lighting devices emitting light into all angles (360°) of a plane perpendicular to the longitudinal axis. As known to the skilled person, some types of automotive lamps, such as e. g. a H4 lamp, use shading elements to emit light from a filament only into specified angular regions, e. g. only 180° in a perpendicular plane. In these cases, the above discussed values for a rotating angle between the two LED assemblies may be adjusted accordingly, in particular to a preferred rotating angle of, in the case of only 180° light emission, about 90°/N.

According to a first concept, each LED assembly comprises only one LED element. In this case, the two LED elements will be arranged next to each other along the rotation axis, but arranged under a rotation angle. While the use of more LED elements per LED assembly will achieve even more uniform light emission, already one LED element per LED assembly, if arranged under the described offset and rotation, may achieve satisfactory results for many applications, in particular for automotive signalling lamps. For the replacement of a prior art incandescent lamp with a wound filament, the LED elements are preferably arranged with their rotation and offset axis coincident with the central axis of the prior wound filament. The offset configuration allows a compact arrangement with dimensions close to the size of prior art filaments. For standardized lamps, corresponding regulations, such as e. g. ECE R37, define a tolerance box within which the filament should be positioned. It is possible to use the space of this tolerance box for placement of the LED assemblies.

In the case of only one LED element per LED assembly, it is further preferred to arrange the first and second LED element so that the main optical directions, as viewed along the axis of rotation, form intersecting lines. Thus, while the LED elements could be arranged to face away from a common center, they are preferably arranged to be directed towards the common center. This further leads to the preferred evenly distributed light emission.

According to an alternative concept, each LED assembly does not only comprise one, but several LED elements. Examples are LED assemblies of e. g. 2-6 LED elements each. Further preferred are LED assemblies of 3-5 LED elements each. For LED assemblies of multiple LED elements, it is further preferred that within each LED assembly, multiple, and preferably all LED elements are arranged in parallel to the axis of rotation, i. e. such that the axis of rotation is parallel to the planes of the planar carrier surfaces. This parallel arrangement allows a very compact structure.

If multiple LED elements are used per LED assembly, it is preferred for them to be arranged next to each other to form LED assemblies with reduced dimensions.

For embodiments with multiple LED elements per LED assembly, it is preferred to arrange the LED elements around a common center, said center preferably being coincident with the rotation axis. While the LED elements may be oriented such that all or a part thereof have a main optical direction of the light emission directed towards the center, it is preferred to arrange, within each LED assembly, multiple, and preferably all LED elements with their main optical directions directed away from the center. The LED elements are preferably arranged around a common mounting core, preferably shaped to fill the space between the LED elements. For example, two LED elements forming an LED assembly may be mounted to a plate-shaped mounting core, three elements may be mounted on an (in cross-section) triangular mounting core, four LED elements on a rectangular mounting core etc. It is particular preferred to provide the mounting core to be made of a heat-conducting material, in particular a metal material, such as e. g. aluminum, copper etc. In this way, the common mounting core may be used as a heat sink. It is possible to provide the mounting core to be made of an electrically conducting material, so that it may be used as electrical contact for operation of the LED elements. However, it is preferred to provide isolated electrical leads to deliver electrical power to the LED elements, isolated from the mounting core.

The shape of LED elements may be chosen according to availability. Available today are mostly LED elements with planar, flat carriers of rectangular shape. In order to obtain, if possible, a very compact arrangement, LED elements should be chosen with small dimensions.

BRIEF DESCRIPTION OF THE DRAWINGS

These and other aspects of the invention will be more readily appreciated as the same becomes better understood by reference to the following detailed description and considered in connection with the accompanying drawings, in which like reference symbols designate like parts.

FIG. 1 is a front view of an LED device according to a first embodiment of the invention;

FIG. 2 is a side view of FIG. 1 with an enlarged portion;

FIG. 3 is a cross-sectional view of the lighting device of FIG. 1, FIG. 2 with the section along the line P in FIG. 1;

FIG. 4 shows a prior art halogen lamp;

FIG. 5*a*, 5*b* show a sectional view and a perspective view of a first example of an LED arrangement for use in a lighting device;

FIG. 6 shows a perspective view of a second example of an LED arrangement;

FIG. 7*a*, 7*b* show a sectional view and perspective view of a third example of an LED arrangement;

FIG. 8*a*, 8*b* show a sectional view and perspective view of a fourth example of an LED arrangement;

FIG. 9*a*, 9*b* show a sectional view and perspective view of a fifth example of an LED arrangement;

FIG. 10 shows a perspective view of a second embodiment of an LED lighting device;

FIG. 11 shows a perspective view of an LED arrangement of the LED lighting device of FIG. 10;

FIG. 12 shows a perspective view of an alternative example of an LED arrangement;

FIG. 13 shows a side view of the LED arrangement of FIG. 11;

FIG. 14 shows a side view of a prior art automotive lamp;

DETAILED DESCRIPTION

Figure 15A:
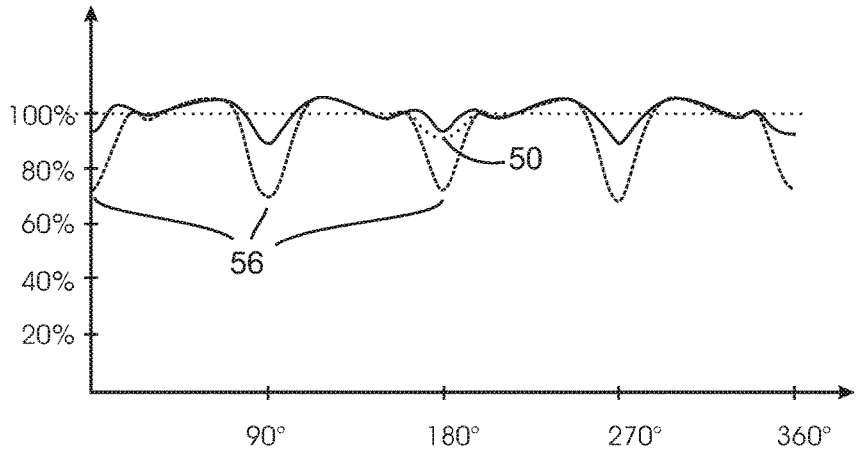
FIGS. 15*a*, 15*b* show diagrams of intensity distributions for the first embodiment of a lighting device of FIG. 1-3 as compared to a prior art reference of FIG. 4.

FIGS. 1-3 show an LED lighting device 10, or LED lamp, which is intended to replace a prior art halogen H8 lamp as shown in FIG. 4. As the prior art H8 halogen lamp, the LED lamp 10 comprises a base 12 with an electrical plug connector 14 which comprises a reference flange 16. The LED lamp 10 is shown in the figures in upright position, i. e. with a longitudinal axis L oriented vertically. As the skilled person will recognize, the orientation will be referred to only for reference, whereas the lamp 10 may be operated in other orientations, and will even preferably be operated in horizontal orientation in a head lighting unit 50 as shown in FIG. 17.

Figure 17:
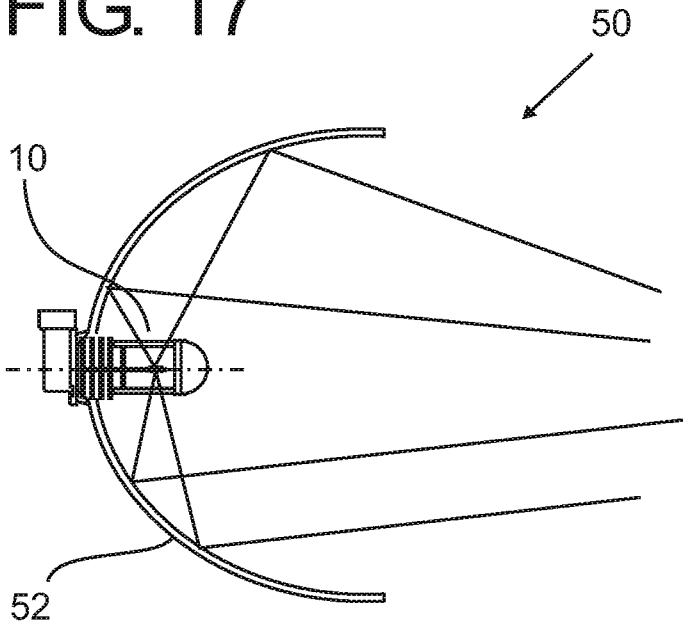
FIG. 17 shows a schematic side view of a head lighting unit with an LED lamp of FIG. 1.

In a prior art head lighting unit, the prior art H8 lamp is mounted in a front lighting reflector 52 of a vehicle as shown in FIG. 17, so that the reference flange 16 is in contact with a reference surface at the reflector 52. The lamp protrudes into the inner reflector space so that a wound filament 8, from which light is emitted, is located at a specified position within the reflector. This positioning, which is necessary to achieve a desired light distribution of the beam emitted from the headlight unit 50, is achieved by a specified position of the filament 8 with regard to the reference flange 16.

In the LED lamp 10 intended to replace the H8 lamp of FIG. 4, an LED arrangement 20 is provided on a mounting rod 22 protruding from the base 12. The LED arrangement 20 comprises, as will be explained in detail below with reference to different examples, a plurality of LED elements arranged relative to each other. In operation of the lamp 10, electrical power is supplied via the plug connector 14. An electrical driving circuit (not shown) integrated in the base 12 provides a DC electrical driving current for the LED elements of the LED arrangement 20, which are thus operated to emit light.

The electrical driving current is conducted to the LED elements by electrical conductors (not shown). For top contacted LED elements, i.e. LED elements with electrical contacts on the top of the flat carrier surface, a flat ribbon cable attached to the mounting rod 22 may provide the electrical connection. The LED elements may then be directly attached to the mounting rod 22 for a good thermal connection.

For bottom contacted LED elements, it is possible to provide electrical contacts on a flexible PCB foil attached to the mounting rod 22. The bottom contacted LED elements may be electrically connected to the PCB foil e.g. by soldering. Additionally, electrically isolated connections may be formed for good thermal contact with the mounting rod 22, e. g. by soldering.

Alternatively, for bottom contacted LED elements, a lead frame may be provided on the mounting rod 22 for electrical and thermal connection. In this case, it is preferred to connect all LED elements electrically in series.

During operation, heat is generated in the LED lamp 10 due to electrical losses in the driver circuit and LED arrangement 20. In order to dissipate the heat, a cooling structure 24 is provided consisting of disks 26 arranged in parallel and spaced from each other in longitudinal direction of the lamp 10. The disks 26 are mounted on the mounting rod 22. As the mounting rod 22, the disks 26 consist of a metal material of high thermal conductivity, such as e. g. copper or aluminum. Thus, heat generated from the driver circuit in the base 12 and from the LED arrangement 20 is dissipated via the mounting rod 22 and cooling structure 24.

As illustrated in FIG. 1, the diameter of the disks 26, and their spacing from the LED arrangement 20 is chosen to leave a lighting angle $\alpha$, defined relative to a horizontal plane P, free from obstructions. Thus, light emitted from the LED arrangement 20 is not obstructed, in a direction of the angle $\alpha$ below the horizontal plane P, by the cooling structure 24. The angle $\alpha$, which in the shown example is about 45°, may be chosen according to the specification of the required LED lamp, e. g. in a range of 20-70°.

The LED lamp 10 further comprises a structure for mechanical protection and heat dissipation including holding bars 28 and a cap 30 of several planar, circular heat fins arranged in parallel, spaced configuration. The protective structure shields the LED arrangement 20 from direct touch when handling the LED lamp 10. Four thin holding bars 28 out of a heat conducting material, such as Aluminum are arranged to hold the cap 30. Shading from the cap 30 is in accordance with the specification for a H8 lamp to block unwanted portions of light. FIG. 17 shows schematically which portions of the light emitted from the lamp 10 are used by the reflector 52 to form a resulting beam pattern. Due to the thin structure of holding bars 28, shading to the sides is minimal.

Instead of four holding bars 28 as shown, it is alternatively also possible to use a different construction, such as e.g. only one holding bar 28, or two holding bars 28, preferably on opposite sides of the mounting rod 22, or three holding bars 28 preferably arranged equally spaced around the mounting rod 22. The holding bars 28, and also the circular heat fins forming the cap 30 may be provided either with a black surface for best heat dissipation, or at least a part thereof may be provided with a specular reflecting surface in order to minimize loss of light, which is not absorbed but reflected at the surfaces. For example, in order to replace a prior art H8 halogen lamp, which has a pole as an electrical connection to the filament extending in parallel thereto, it is preferred to use only one holding bar 28 in the same position as the electrical connection pole.

In order to replace a prior art halogen H8 lamp, the LED lamp 10 is designed to provide a light emission from the LED arrangement 20 which comes close to the light emission from a prior halogen incandescent H8 lamp. A decisive requirement is the spatial light distribution, i. e. how the intensity of the light emitted from the LED arrangement 20 is distributed into different lighting directions.

In most automotive lamps, the portions of the light used in head lighting units 50 such as shown in FIG. 17, are mostly those emitted to the sides of the lamp 10. Thus, the light distribution in the reference plane P, shown in FIGS. 1-4 oriented horizontally, i. e. perpendicular to the longitudinal axis L of the lamp 10, is most important. FIG. 15*a* shows, for a H8 halogen reference lamp, the intensity distribution under different angles in this plane as a dotted line. The light intensity emitted under angles of 0-360° is shown as almost constant (where intensity values measured in candela are normalized, so that the intensity is shown, for almost in all angles, as a value of 100%). Only under an angle of 180° the curve shows a dip 51 where light is blocked by the electrical pole connection.

Figure 15B:
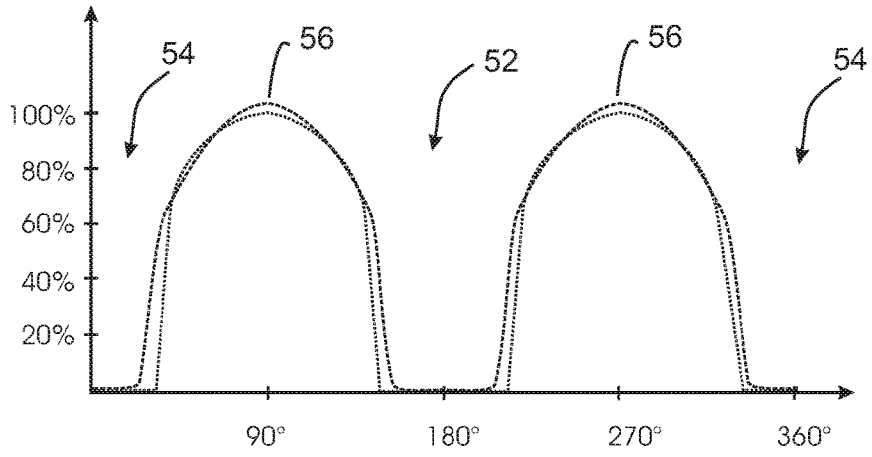

FIG. 15*b* shows the intensity distribution under angles 0-360° in a vertical plane parallel to the longitudinal axis L. For a prior art H8 halogen reference lamp, the intensity distribution in this plane is shown as a dotted line. This intensity curve shows intensity maxima 56 in the direction of the reference plane P, i. e. under angles of 90° and 270°. Due to the cap 30 and base 12, light emitted under angles around the longitudinal axis L, is shaded so that the curve shows a central minimum 52 around 180° and, in directions around 0°, another minimum 54 where light emitted is shaded at the base 12 of the prior art halogen H8 lamp.

In designing an LED lamp 10 with an LED arrangement 20 to replace a prior art halogen lamp, the aim is thus to achieve as closely as necessary (within the boundaries given by automotive specifications) the same light distribution as prior art incandescent lamps, in particular the relatively uniform distribution in the horizontal plane (FIG. 15*a*). On the other hand, the LED arrangement 20 emitting the light should in its outer dimensions come close to the wound filament 8 of prior art halogen lamps, and be arranged at the same relative position to the positioning flange 16.

The present invention deals with a general idea and with example embodiments of this idea how to achieve a relatively small structure for an LED arrangement 20 providing a light distribution sufficiently uniform to replace a prior art halogen lamp. The basic idea is to arrange LED assemblies 30, 32 both offset and under a rotating angle γ.

As shown in the enlarged portion of FIG. 2, the LED arrangement 20 is comprised, in a first example, of two LED assemblies 30, 32 mounted on a common mounting core, or rod, 22. As further illustrated in FIG. 5*a*, 5*b* each of the two LED assemblies 30, 32 is comprised of three planar LED elements 34*a*, 34*b*, 34*c*; 36*a*, 36*b*, 36*c*. The LED assemblies are arranged along a longitudinal axis A, which may also be termed a rotation axis A, and which in the example shown is oriented parallel to the longitudinal axis L of the LED lamp 10.

The LED elements 34*a*, 34*b*, 34*c*; 36*a*, 36*b*, 36*c* are all of identical type. Each LED element comprises, as best viewed in FIG. 5*b*, a rectangular plate acting as a planar flat carrier 38, on which an LED chip 40 is mounted. The LED chip 40 emits light mainly into the half space above the carrier surface plane. The intensity distribution of the light emitted may ideally be that of a lambertian emitter, but could also be modified by primary optics e. g. focused by optical elements such as lenses etc. In the shown preferred example of an LED element without primary optics, the main optical direction of the light emission is perpendicular to the plane of the surface of the carrier 38. The individual main optical directions of the LED elements 34*a*, 34*b*, 34*c*; 36*a*, 36*b*, 36*c* are shown as arrows in FIG. 5*a*. The carrier plate 38 provides electrical contact for the LED chip 40 and serves for mechanical mounting and as thermal contact.

In the preferred embodiment shown, the electrical contacts are wired through the carrier plate to the back side thereof, where they are contacted to structured electrical wires (not shown) on the surface of the mounting rod 22.

Such flat, planar LED elements are available e. g. from Philips Lumileds Lighting Company. For example, LED elements of the Luxeon C-type have a length parallel to the axis A of 2.04 mm and a width perpendicular to A of typically 1.64 mm. The LED chip die, i. e. the lighting emitting surface, typically has dimensions of $1\times1$ mm$^2$. At operating currents of e. g. 500 mA, the luminous flux generated from this type of LED element is 120 lm.

As visible from the view in FIG. 5 along the rotation axis A, each LED assembly 30, 32 comprises three of these LED elements arranged in (in cross-section) triangular configuration around the central mounting rod 22. The mounting rod 22 is also of triangular shape in cross-section and comprises differently shaped portions to accommodate both LED assemblies 30, 32. As visible from the figures, the LED elements 34*a*, 34*b*, 34*c* are arranged on the central mounting rod 22 with their edges next to each other to obtain an LED assembly 32 of small outer dimensions. The rectangular LED elements are arranged with their longer dimension parallel to the axis A, which also leads to smaller dimensions perpendicular to the axis A. In each of the LED assemblies 30, 32, the LED elements 34*a*, 34*b*, 34*c*; 36*a*, 36*b*, 36*c* are arranged parallel to the rotation axis A, i. e. the planes defined by the surfaces of each of the carriers 38 are parallel to the rotation axis A.

Further, the LED assemblies 30, 32 enclose a rotation angle γ with each other as visible from the view along the rotation axis A in FIG. 5*a*. The rotation angle γ may be defined between a first LED element 34*a* from the first LED assembly 32 and a second LED element 36*a* from the second LED assembly 30, as shown in FIG. 5*a*. This rotation angle leads to an equal angle between the main optical directions of the LED elements 34*a*, 36*a*.

In the example shown, the rotation angle γ is equal to 60°. This values has been chosen due to the symmetrical arrangement of three LED elements 34*a*, 34*b*, 34*c* for each of the LED assemblies 30, 32 which is rotationally symmetrical for 360°/3=120°. As will be appreciated by the skilled person, a rotation angle γ of half the value of the symmetry angle leads to an even distribution of the different main optical directions (indicated by arrows in FIG. 5) around the rotation axis A.

The LED assemblies 30, 32 are arranged offset from each other along the rotation axis A. As further visible from FIG. 5*b*, since the arrangement of the LED chip 40 on the carrier 38 is not completely symmetrical, the LED elements from the two LED assemblies 30, 32 are rotated 180° so that the LED chips 40 are arranged close to each other.

The LED assemblies 30, 32 are arranged with their respective edges right next to each other, so that the structure from which light is emitted is as compact as possible. In the example shown, the LED assemblies 30, 32 are displaced along the rotation axis A by only little more than their length, so that the first and second LED assembly 30, 32 are located close to each other.

The very compact structure obtained by arranging the two LED assemblies 30, 32 next to each other, offset along the rotation axis A, serves to obtain an LED arrangement 20, where the outer dimensions closely resemble the outer dimensions of a prior art halogen filament 8.

Further, the rotated arrangement provides a very uniform light distribution in a horizontal plane. As shown in FIGS. 15*a*, 15*b*, where the dashed line indicates the intensity for different angles in the central horizontal plane P (FIG. 15*a*) and a vertical plane parallel to L (FIG. 15*b*), the measured intensity of the first embodiment of an LED lamp 10 approximates the intensity distribution of the prior art H8 halogen lamp (dotted line).

As shown in FIG. 15*a*, the intensity curve shows four dips 56 due to the four holding bars 28, which in the shown example have a light absorbing, non-reflecting surface. As an alternative example, holding bars 28 of specular reflective surface were used. The intensity distribution of this alternative example is shown in FIG. 15*a* as a solid line. Due to the reflective properties of the holding bars 28, the dips 56 are less noticeable for this alternative example. However, specular reflective surfaces may lead to an image with additional virtual light sources due to the reflection, which could cause glare. Still, in both the embodiment of FIGS. 1-3 and the alternative embodiment, the intensity approximates the distribution of the prior art H8 lamp. The measured intensity oscillates around 100% with only small deviations. Thus, the LED lamp of FIG. 1-3 with the LED arrangement of FIG. 5*a*, 5*b*, is well suited for LED replacement of prior art halogen lamps. The further preferred embodiment with only one holding bar 28 arranged under 180° (not shown) will come even closer to the properties of the original H8.

In the vertical plane, the measured intensity distribution (dashed line) also approximates the prior art H8 lamp (dotted line) quite closely. Due to the design of the cap 30 and the cooling structure 24, the same dips 52, 54 are visible in the resulting intensity distribution.

For a replacement of the prior art halogen lamp shown in FIG. 4, the LED arrangement 20 is preferably arranged with its rotation/offset axis A coincident with the axis of the prior wound filament 8. For lamps, of which primarily the light emitted to the sides is used in a head lighting unit 50 (see FIG. 17), this orientation has proven to yield good results.

FIG. 6 shows an alternative example of an LED arrangement, where additionally to LED assembly 30, 32, a third LED assembly 33 is provided on the mounting rod 22. The third LED assembly 33 is again axially displaced, e. g. arranged at an offset along the rotation axis A with respect to the other LED assemblies 30, 32. It is arranged under a rotation angle with respect to the second LED assembly 32. In the example shown, the third LED assembly 33 is arranged with a rotation angle of 0° with respect to the first LED assembly 30, but in still alternative embodiments it could be arranged under a different rotation angle to provide an even more uniform distribution. Also, even further LED assemblies may be provided.

FIGS. 7*a*, 7*b* show a third example of an LED arrangement, where less LED elements are arranged on a mounting core 22 in a non-symmetrical arrangement. A first LED assembly 30*a*, a second LED assembly 32*a*, and a third LED assembly 33*a*, which each comprise only one LED element mounted on a common mounting rod 22, are arranged in offset configuration along the rotation axis A and each comprise a rotation angle γ of 60°. Since only three LED elements are arranged under the rotation angle of 60° each, an intensity distribution in the central plane P will result, where a uniform distribution is only achieved for a half space (not shown). Such an LED arrangement may be used for applications where a uniform intensity only for a half space is sufficient, such as e. g. for the replacement of prior art halogen lamps which comprise a shielding plate (e. g. H4) to limit the light distribution.

FIGS. 8*a*, 8*b*, 9*a*, 9*b* show still further examples of LED arrangements. In FIG. 8*a*, 8*b* a first LED assembly 30*b* and a second LED assembly 32*b* each comprise four LED elements mounted around a square mounting rod 22. The first and second LED assembly 30*b*, 32*b* are arranged offset along the rotation axis A and enclose a rotation angle γ of 45° (half of the symmetry angle of 90°).

In the further example of FIG. 9*a*, 9*b*, each of two LED assemblies 30*c*, 32*c* comprises 5 LED elements. Again, the LED assemblies are arranged offset along the rotation axis A and enclose a rotation angle γ of 36°.

FIG. 10 shows a second embodiment of an LED lamp 110. The LED lamp 110 is intended to replace an automotive signalling lamp shown in FIG. 14. Both the LED lamp 110 and the prior art signalling lamp have a lamp base 112 comprising the electrical contacts and mechanical reference elements for positioning the lamp in an automotive lamp socket for signalling purposes, such as e. g. for a turning indicator, brake light etc.

The prior art lamp is an incandescent lamp comprising a tungsten filament 108. To replace the prior art lamp of FIG. 14, the LED lamp of FIG. 10 includes an LED arrangement 120. The LED arrangement 120 is mounted to the base 112 via a support 122. An electrical driver circuit (not shown) is integrated in the base 112 and electrically connected to the LED arrangement 120.

A cooling arrangement 124 comprises three cooling disks 126 mounted to the support 122. Additionally, the cooling structure 124 comprises cooling fins 127 oriented vertically, parallel to the longitudinal axis of the LED lamp 110. The cooling arrangement 124 serves to dissipate heat generated in operation by the driver circuit within the lamp base 112 and by the LED arrangement 120.

As shown in FIG. 11, the LED arrangement 120 comprises a first LED assembly 130 and a second LED assembly 132. In this case, both the first and second LED assembly 130, 132 each comprise only one LED element 134, 136. Each of the LED elements 134, 136 is comprised of a rectangular, planar carrier plate 138 and an LED chip 140 mounted thereon.

The LED elements 134, 136 of the LED assemblies 130, 132 are mounted in parallel to a longitudinal axis A, i. e. the planes defined by the surfaces of the carrier plates 138 are parallel to the axis A, as shown in FIG. 11.

The LED elements 134, 136, and therefore also the LED assemblies 130, 132 are arranged, with respect to the rotation axis A, to enclose a rotation angle γ, as shown in the view of FIG. 13 along the rotation axis A. Additionally, the LED assemblies 130, 132 are arranged in offset configuration, i. e. linearly displaced in a direction parallel to the rotation axis A. In the example shown, the LED elements 134, 136 are arranged right next to each other, i. e. the offset between them is about equal to the length of the LED elements 134, 136. Thus, the LED elements 134, 136 are arranged close to each other to form a compact light emitting structure.

The rotation angle γ, under which the LED elements 134, 136 are arranged (FIG. 13) leads to a light angle defined between the main light directions of the LED elements (shown in FIG. 13 with arrows). Since in the present example the LED elements comprise LED chips 140 without optics, the emission is ideally close to a lambertian emitter, so that a main optical direction will be perpendicular to the plane of the carrier 138. Thus, the light angle in this case will be equal to the rotation angle γ.

Further, in the example shown, the LED elements 136, 134 are provided in mirrored configuration, such that they are—in the view along the rotation axis A—at least partly facing each other. Thus, their main optical directions form intersecting lines in this view.

In the design of the LED lamp 110 to replace the prior art lamp shown in FIG. 14, the rotation axis A is positioned in parallel to the location of the wound filament 108 of a prior art lamp. The LED arrangement 120 is located, by reference to the base 112, at the same position as the filament in the prior art lamp.

Figure 16A:
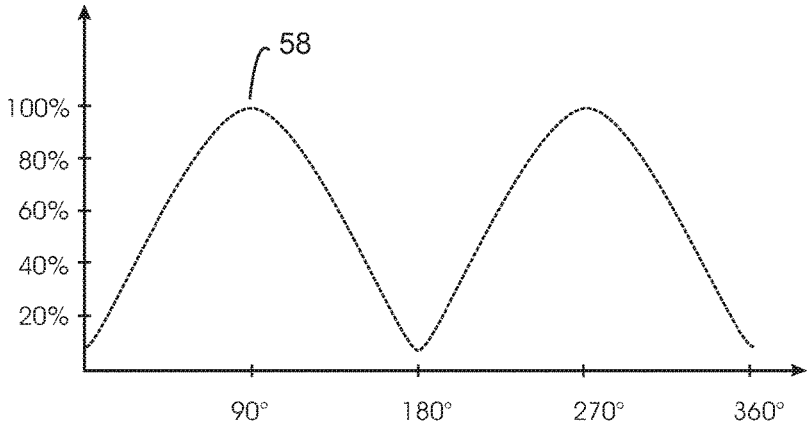
FIGS. 16*a*, 16*b* show diagrams of intensity distributions of the second embodiment of FIG. 10 with the LED arrangement of FIG. 11.
Figure 16B:
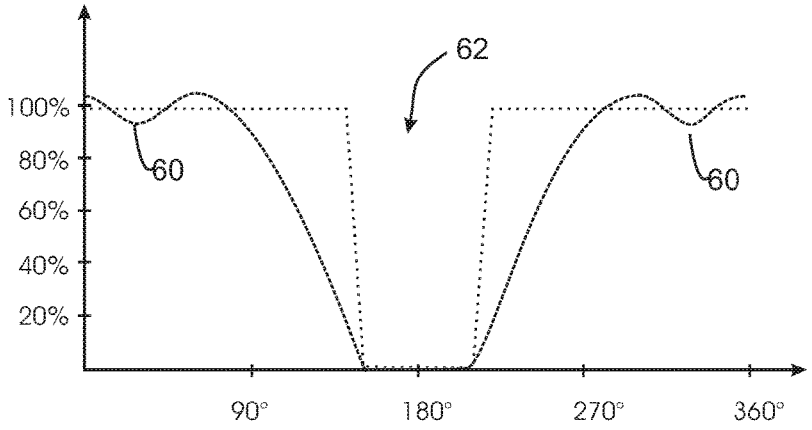

FIGS. 16*a*, 16*b* show the resulting a light distribution, i. e. the relative intensity (measured in candela, but shown here as normalized values) of light emitted from the lamp 110. FIG. 16*a* shows the intensity distribution in a horizontal plane P (FIG. 13), whereas FIG. 16*b* shows the intensity distribution in a vertical plane parallel to the longitudinal axis L of the lamp 110 (FIG. 10). Shown as a dotted line in FIG. 16*b* is a specification of minimum intensity emission required by automotive regulations. For angles around 180°, where the lamp base 112 is located, no light output is required. The light distribution curves of the LED lamp 110 with two LED assemblies 130, 132, each with only one LED element 134, 136 is shown in FIGS. 15*a*, 15*b* as a dashed lines.

In the horizontal plane P, the intensity distribution of the LED lamp 110 of FIG. 10 shows two maxima at angles of 90° and 270°, i. e. perpendicular to the cooling fins 127 and to the LED elements 140. Shading by the heat fins 127 occurs only under angles of around 0° and 180°, i. e. in directions where the light intensity is already at a minimum. As such, the intensity distribution in the horizontal plane P approximates that of the prior art incandescent lamp (FIG. 14), where the tungsten filament 108 emits light of relatively small intensity in its longitudinal direction.

In the vertical plane, parallel to the longitudinal axis L, light emission shown as a dashed line has a central minimum 62, where light is shaded at the cooling disks 126. Under angles of between 200° and 330° no light emission is required, so that this shading is no problem.

Additional dips 60 are noticeable where light from one LED chip 140 is shaded at the other, respectively. Still, the required intensity distribution (dotted line) is approximated to a sufficient degree.

FIG. 12 shows an alternative arrangement 120*a* of four LED assemblies, each comprising only one LED element, arranged rotated and displaced along the axis A.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term "coupled" as used herein, is defined as connected, although not necessarily directly, and not necessarily mechanically.

The invention claimed is:

1. A lighting device, comprising:

first and second LED assemblies, each of said LED assemblies comprising one LED element comprising an LED chip and a carrier with a planar surface for carrying the LED chip, said LED chip emitting light with a main optical direction, wherein:

a first LED element of said first LED assembly and a second LED element of said second LED assembly are fixedly mounted in parallel to an axis of rotation (A) so a first planar surface of said first LED assembly and a second planar surface of said second LED assembly are parallel to said axis of rotation (A), said axis of rotation (A) being perpendicular to a longitudinal axis (L) that runs along a long side of the lighting device;

said first and said second LED assemblies are fixedly mounted relative to each other so that said first LED element from said first LED assembly and said second LED element from said second LED assembly enclose a rotating angle (γ) between their respective planar surfaces with respect to said axis of rotation (A), so as to involve a light angle between the first and second main optical directions; and said first and second LED assemblies are fixedly arranged in an offset configuration so said first and said second LED assemblies are linearly displaced as a whole from each other parallel to said axis of rotation (A).

2. Lighting device according to claim 1, wherein said main optical directions of said LED elements intersect each other as viewed along said axis of rotation (A).

3. A lighting device, comprising:

first and second LED assemblies, each of said LED assemblies comprising at least one LED element comprising an LED chip and a carrier with a planar surface for carrying the LED chip, said LED chip emitting light with a main optical direction, wherein:

a first LED element of said first LED assembly and a second LED element of said second LED assembly are fixedly mounted in parallel to an axis of rotation (A) so a first planar surface of said first LED assembly and a second planar surface of said second LED assembly are parallel to said axis of rotation (A);

said first and said second LED assemblies are fixedly mounted relative to each other so said first LED element from said first LED assembly and said second LED element from said second LED assembly enclose a rotating angle (γ) between their respective planar surfaces with respect to said axis of rotation (A), so as to involve a light angle between the first and second main optical directions;

said first and second LED assemblies are fixedly arranged in an offset configuration so said first and said second LED assemblies are linearly displaced as a whole from each other parallel to said axis of rotation (A); and said main optical directions of said LED elements intersect each other as viewed along said axis of rotation (A).

* * * * *